United States Patent [19]

Logan

[11] Patent Number: 4,582,011

[45] Date of Patent: Apr. 15, 1986

[54] HYDROFOIL VESSEL

[76] Inventor: William F. Logan, 70 Laight St., New York, N.Y. 10013

[21] Appl. No.: 510,364

[22] Filed: Jul. 1, 1983

[51] Int. Cl.[4] ..... B63B 1/28; B63H 9/04

[52] U.S. Cl. ..... 114/39; 114/61; 114/280

[58] Field of Search ..... 114/39, 61, 274, 280–283

[56] References Cited

U.S. PATENT DOCUMENTS

| | | | |
|---|---|---|---|
| 1,709,219 | 4/1929 | Hille | 114/39 |
| 2,767,678 | 10/1956 | Vertens | 114/280 |
| 2,906,229 | 9/1959 | Boericko, Jr. | 114/281 |
| 3,839,979 | 10/1974 | Wassell | 114/39 |
| 3,949,695 | 4/1976 | Pless | 114/39 |

FOREIGN PATENT DOCUMENTS

| | | | |
|---|---|---|---|
| 362712 | 8/1934 | Fed. Rep. of Germany | 114/39 |
| 1069256 | 5/1967 | United Kingdom | 114/39 |

*Primary Examiner*—Sherman D. Basinger
*Attorney, Agent, or Firm*—Ladas & Parry

[57] ABSTRACT

A vessel having adjustable hydrofoils. The vessel is preferably a multi-hull sailing vessel such as a catamaran or trimaran. The hydrofoils diverge upwardly and outwardly from a location below the waterline of the vessel and in the plane of the longitudinal axis of the vessel. The hydrofoils are pivotally mounted at the inner lower ends thereof to permit said hydrofoils to pivot forwardly and rearwardly to alter the angle of attack of said hydrofoils.

9 Claims, 12 Drawing Figures

HYDROFOIL VESSEL

The present invention relates to hydrofoil vessels and, in particular, to multi-hull sailing hydrofoil vessels.

Waterborne sailing hydrofoil vessels have been experimented on and refined for decades but still present a substantial number of problems. U.S. Pat. No. 3,911,845 is concerned with a sailing hydrofoil vessel but does not have the advantages of the present invention. U.S. Pat. No. 4,164,909 also relates to a wind-driven hydrofoil watercraft although is not strictly concerned with a sailing vessel.

One of object of the present invention is to provide means whereby the angle of attack of a hydrofoil may be precisely and incrementally adjusted to optimize lift and minimize drag for various hull speeds and weather conditions.

A further object of the present invention is to provide a multi-hull vessel which can be easily righted following capsize. In connection with this object it will be appreciated that conventional multi-hull vessels are difficult to right following capsize due to the stability inherent in spaced floats or hulls which are buoyant in an inverted position.

A still further object of the present invention is to facilitate transport over land of the vessel by reducing the overall vessel width. Reduction of the overall vessel width is also advantageous when mooring in crowded marinas, etc.

SUMMARY OF INVENTION

According to one aspect of the present invention there is provided a vessel incorporating at least one hull member, at least one pair of hydrofoils diverging upwardly from a location below said hull member and adjustable support means interconnecting said hull member and said hydrofoils, the lower end of each said hydrofoil being mounted for pivotal movement about a substantially vertical axis to permit forward and rearward movement of the hydrofoils about said substantially vertical pivotal axis and with respect to said hull member thereby to alter the angle of attack of said hydrofoils.

The invention is particularly suited to multi-hull vessels and according to a further embodiment of the invention there is provided a trimaran comprising a main hull member, two outer hull members located one on each side of said main hull member in substantially parallel relationship therewith, strut means pivotally interconnecting said main hull member with the outer hull members, at least one pair of hydrofoils diverging upwardly from a location below said main hull member towards said outer hull members, said hydrofoils being pivotally mounted at their lower ends for pivotal movement about substantially vertical axes whereby each strut and hydrofoil may pivot forwardly and rearwardly about the respective pivotal axis to alter the spacing between the main hull member and associated outer hull member and to alter the angle of attack of the hydrofoil.

According to a still further embodiment of the invention there is provided a catamaran comprising substantially parallel twin hull members, central structure located between said hull members, strut means pivotally interconnecting said central structure with said hull members, at least one pair of hydrofoils diverging upwardly from a location below said central structure towards said hull members, said hydrofoils being pivotally mounted at the lower ends thereof for pivotal movement about substantially vertical axes whereby each said strut and hydrofoil may pivot forwardly and rearwardly about the respective pivotal axis to alter the spacing between the central structure and the hull members to alter the angle of attack of the hydrofoil.

DESCRIPTION OF DRAWINGS

In order that the invention may be more clearly understood and readily carried into effect, various embodiments thereof will now be described with reference to the accompanying drawings in which.

DETAILED DESCRIPTION

Figure 1:
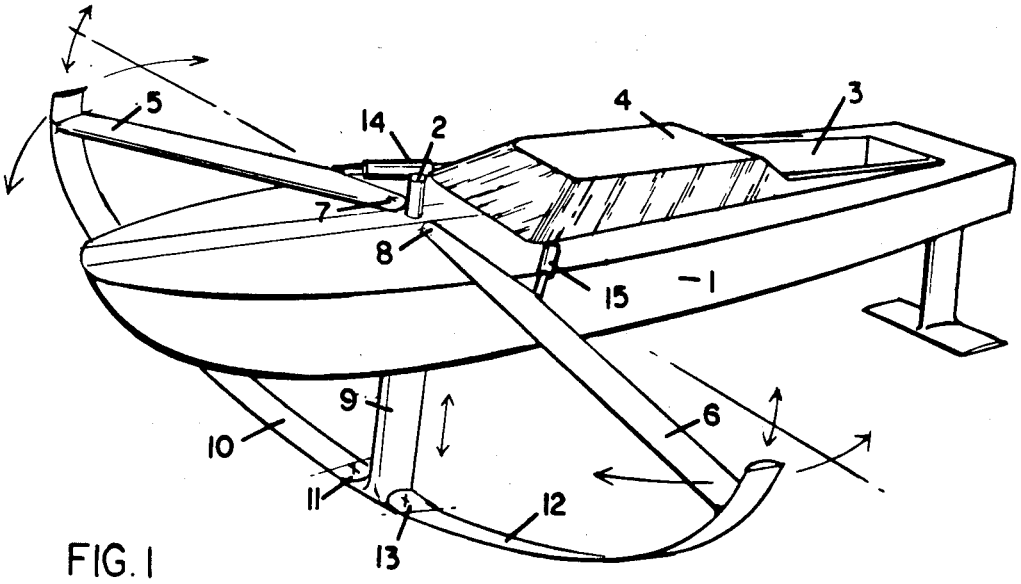
FIG. 1 shows a single-hull vessel provided with hydrofoils in accordance with one embodiment of the invention.
Figure 2:
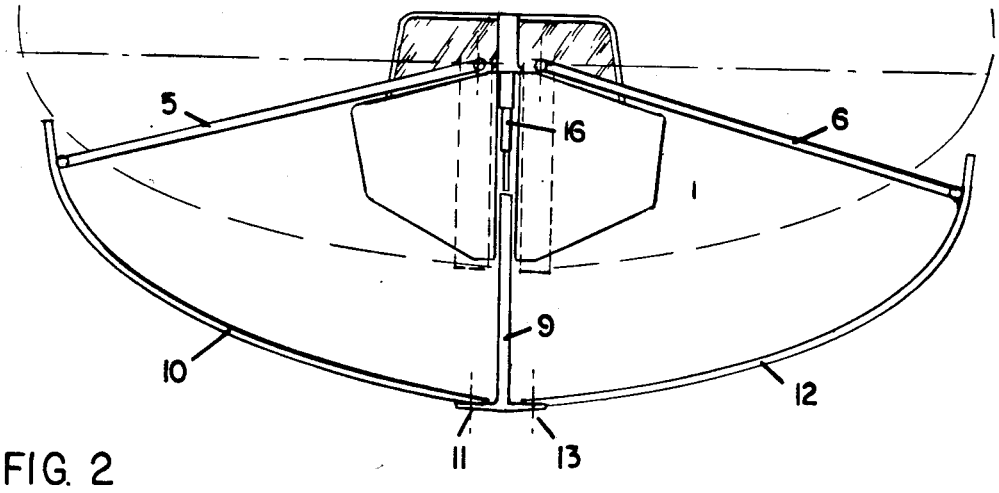
FIG. 2 is an end view of the vessel shown in FIG. 1.

Referring now to the drawings, FIG. 1 shows a sailing vessel incorporating a hull 1, a mast 2, a cockpit 3 and cabin structure 4. Forward of the cabin structure in the plane of the mast two struts 5, 6 are pivotally mounted at 7, 8 to the hull 1. The port strut 6 is shown angled at right angles with respect to the longitudinal axis of the hull 1 whereas the starboard strut 5 is shown angled forwardly. The struts 5, 6 may be angled all the way forward to lie substantially parallel to the longitudinal axis of the vessel as shown in phantom outline in FIG. 1.

A fin 9 depends from the underside of the hull and is shown in substantial alignment with the mast 2. A first hydrofoil 10 is pivotally mounted at 11 at the lower end of the fin 9 and extends upwardly to the outer end of the strut 5. A second hydrofoil 12 is similarly pivotally mounted at 13 at the lower end of the fin and extends upwardly to the strut 6. It will be appreciated that when the struts 5, 6 are displaced forwardly, the hydrofoils 10 and 12 move about their respective pivot points and at all times lie in the same vertical plane as their respective struts. The fin 9 is vertically displaceable and may be retracted and extended as shown by the double-headed arrow in FIG. 1.

The angle of the struts 5, 6 may be adjusted in controlled manner by any suitable means, for example by hydraulic jacks 14, 15. Hydraulic jack means 16 may also be utilized to extend and retract the fin 9.

Figure 3:
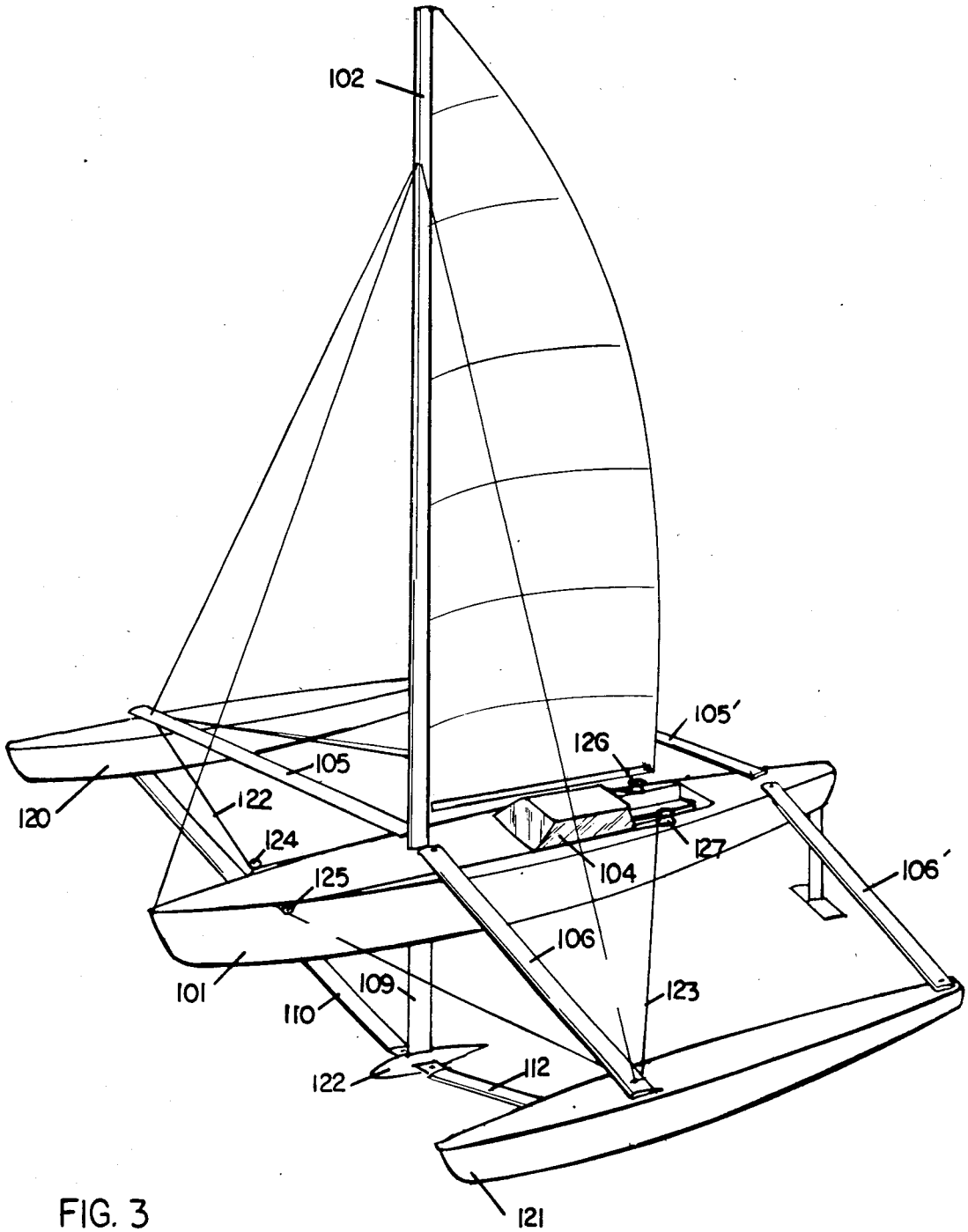
FIG. 3 is a perspective view of a second embodiment of the invention in which the hydrofoil arrangement of the invention is embodied in a trimaran.

FIG. 3 of the drawings shows a trimaran having a main hull 101, a mast 102, a cockpit 103 and cabin structure 104. The trimaran includes outer hulls 120, 121 lying substantially parallel to the main hull 101 and interconnected by struts 105, 105' and 106, 106'. A fin 109 depends from the underside from the main hull and hydrofoils 110, 112 are pivotally mounted one on each side of a fairing 122 at the lower portion of the fin 109.

As shown in FIG. 3 of the drawings, the struts 105, 106 are pivotally mounted at one end on the deck of the hull 101 and are pivotally mounted at the opposite ends on the decks or upper sides of the hulls 120, 121. The struts 105', 106' are similarly pivotally mounted on the main hull and outer hulls.

The main hull 101, struts 106, 106' and outer hull 121 together form a first parallelogram which can pivot in unison to advance and withdraw the outer hull 121 with respect to the main hull 101 whilst at all times remaining parallel thereto. Similarly, the main hull 101, outer hull 120 and struts 105, 105' define a second parallelogram. In the embodiment shown in FIG. 3, pivotal movement of the struts is controlled by cables 122, 123 which pass around pulleys 124, 125 and are controlled by winches 126,127 located at the cockpit 103.

Figure 4:
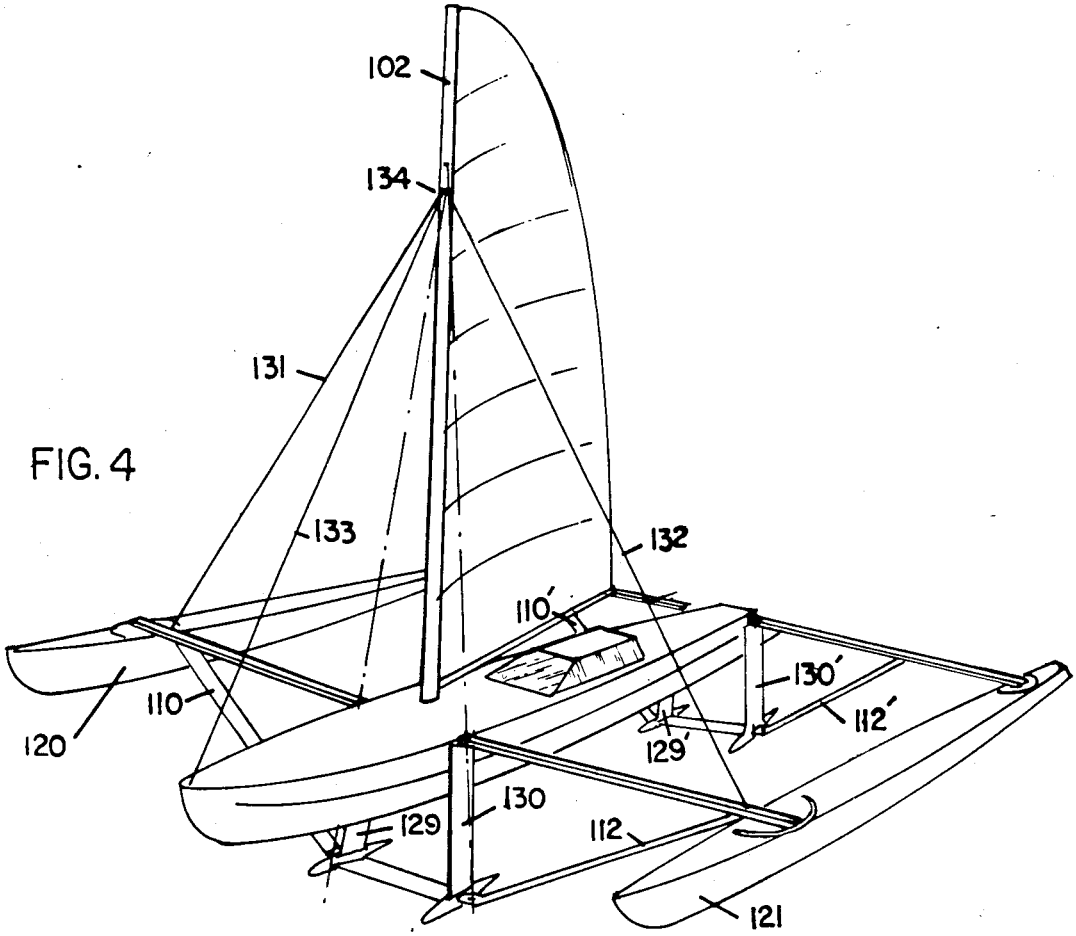
FIG. 4 is a perspective view similar to FIG. 3 but showing an alternative form of trimaran.
Figure 5:
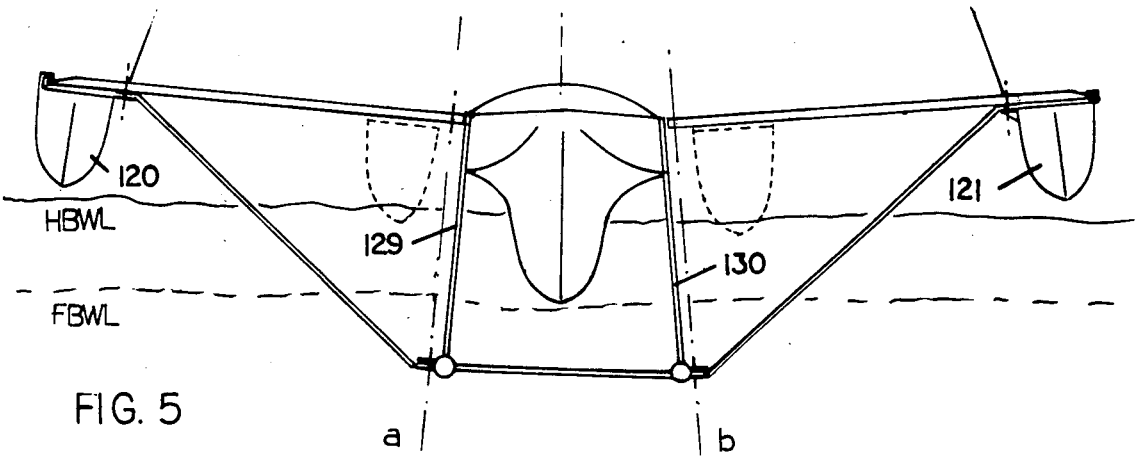
FIG. 5 is an end view of the vessel shown in FIG. 4.

It will be appreciated that when the outer hull 121 is moved forwardly, by pivotal movement of the struts 106, 106', with respect to the main hull 101, said outer hull will also move closer to the main hull and, at the extremity of forward movement, will lie alongside the main hull. It will further be appreciated that, as most clearly shown in FIG. 12 of the drawings, the hydrofoils 110, 112 will not only advance with forward movement of the outer hulls 120, 121 but, moreover, will alter their angle of attack in the water. In this manner the lift imparted by the hydrofoils will be controlled to raise the hulls above their normal waterline thereby reducing hull drag and increasing the speed of the vehicle. Moreover, when it is desired either to berth the trimaran on a mooring or to transport the trimaran overland on a trailer, by pivoting the outer hulls forwardly to lie adjacent the main hull, the overall width of the vehicle will be very substantially decreased. Additionally, should the vessel capsize, the inherent stability caused by three spaced hull members makes it very difficult to right. However, by moving one or both of the outer hulls forwardly and inwardly with respect to the main hull, the overall configuration of the vehicle is substantially changed and it becomes very much easier to right the vessel. FIGS. 4 and 5 show a modified version of the trimaran shown in FIG. 3. In the embodiment shown in FIGS. 4 and 5, the single fin 109 is replaced twin fins 129,130. The advantage of twin fins depending from the main hull member is that they can be located one on each side of the hull member and in this manner will not provide an internal constriction of the fin casing extending through the hull. FIG. 4 moreover shows an embodiment including two pairs of hydrofoils 110, 112 and 110', 112'. To this end, the fins 129, 130 represent a forward set of fins and additional fins 129', 130' are located aft of the vessel and, like the forward fins, depend one from either side of the main hull.

Two additional features are clearly shown in FIGS. 4 and 5 of the drawings. Firstly, it is a feature of the vessel of the invention that the hydrofoils are in tension whereas the struts are in compression. In the preferred embodiments illustrated, the trimaran is a sailing trimaran and the mast 102 is in part supported by shrouds 131, 132 and a forestay 133. When the struts and hydrofoils pivot forwardly in a controlled manner to alter the angle of attack of the hydrofoils, it is important that the shrouds 131, 132 also remain in tension. This is achieved by locating the anchorage 134 of the shrouds 131, 132 on the mast 102 at the location at which the pivot axis a, b of the hydrofoils and the inner struts ends intersect with the mast 102.

Secondly, FIGS. 4 and 5 show an alternative pivotal mounting of the outer ends of the hydrofoils 110, 112 on the outer hulls 120, 121. Whereas in the embodiment shown in FIG. 3, and more clearly in FIGS. 10 and 11 to be described hereinafter, the hydrofoils are pivotally mounted on the underside of the outer hulls, in the embodiment shown FIGS. 4 and 5, the upper outer ends of the hydrofoils are pivotally mounted at or proximate the deck level of the outer hulls. The pivotal connection at this location is effected by a pin or like pivot member extending through the laterally extending struts at locations short of their outer ends. The outer extremities of the struts move in arcuate guideways provided on the outer hull members. FIG. 5 shows how the outer guideways are in fact slots which accommodate the outer extremities of the struts. It will, however, be appreciated that the arcuate guideways could be channels formed in the upper portions of the outer hulls and arranged to accommodate a depending pin or peg provided at the outer end of the struts.

Figure 6:
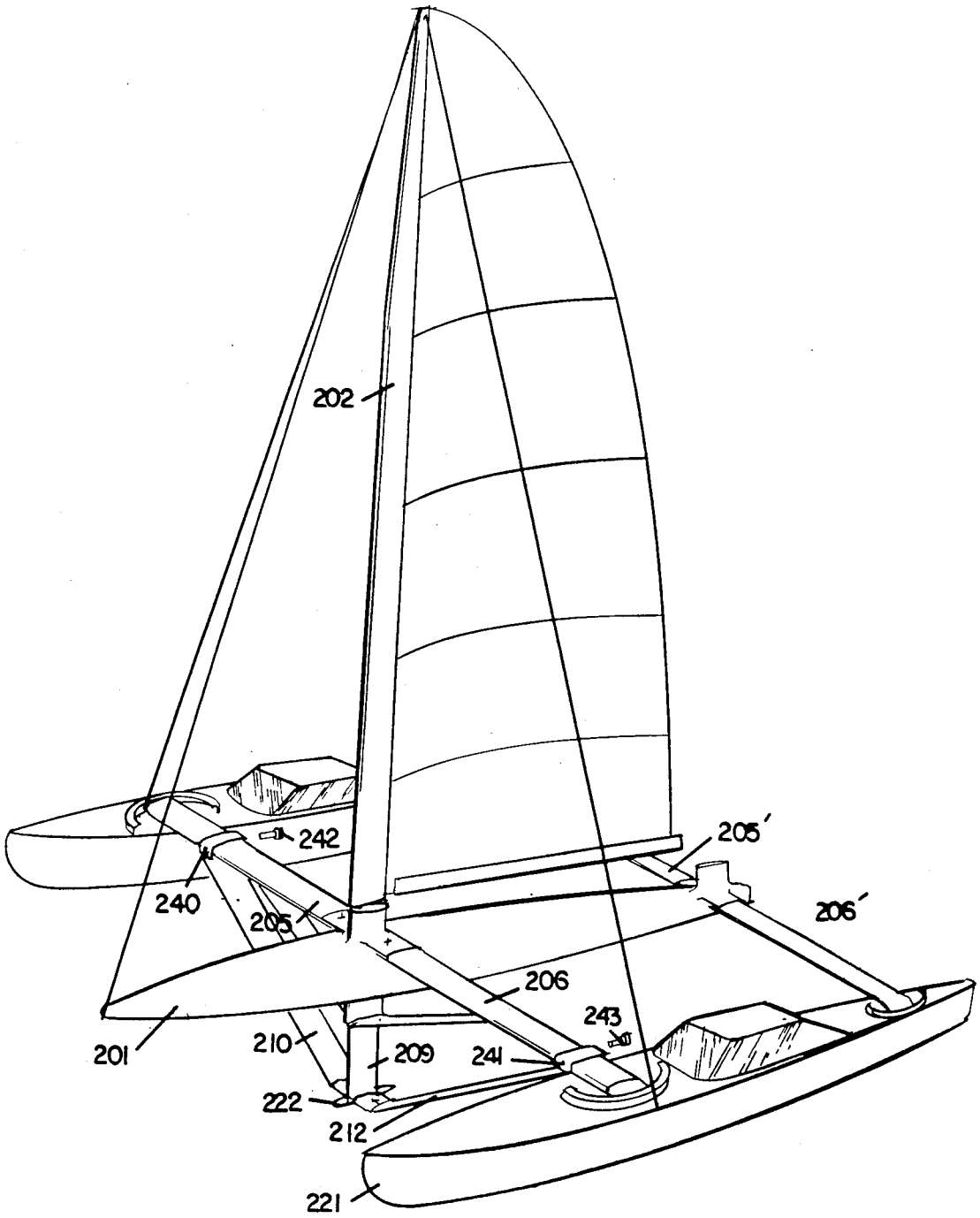
FIG. 6 is a perspective view of a further embodiment of the invention in the form of a catamaran.
Figure 7:
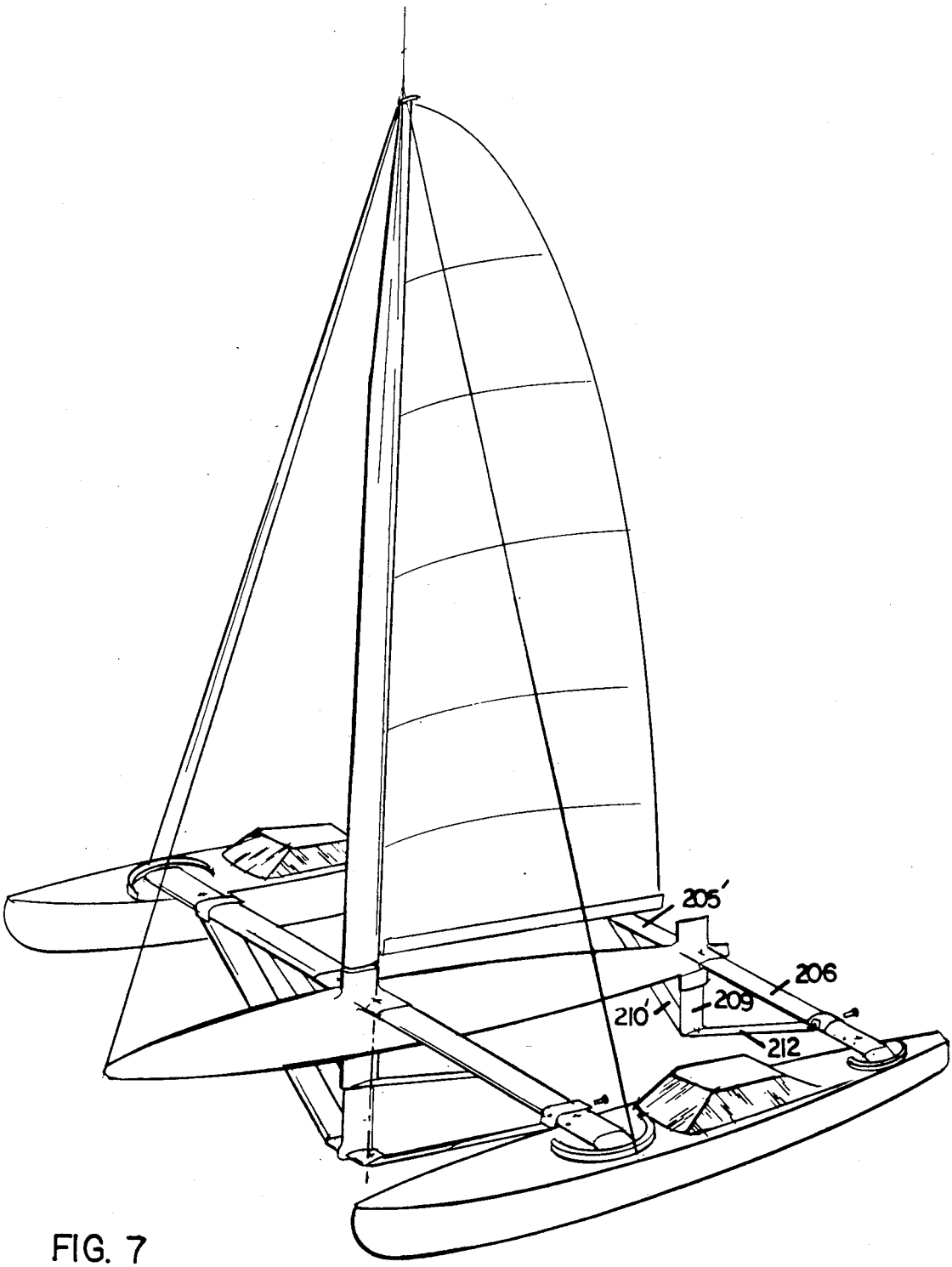
FIG. 7 is a view similar to FIG. 6 but showing an alternative form of catamaran.

FIGS. 6 and 7 show catamarans embodying the invention. Apart from the provision of a second or aft hydrofoil 210' 212' diverging upwardly and outwardly from a rearward fin 209', the catamaran shown in FIG. 7 is in all respects similar to that shown in FIG. 6.

Referring now to FIG. 6, the catamaran comprises two hulls 220, 221 and a central structure 201 supporting a mast 202. The central structure 201 additionally has struts 205, 206 and 205', 206' pivotally mounted on and extending outwardly therefrom. The outer ends of the struts engage the hulls 220, 221 through pivotal mountings which permit each of the hulls independently to move forwardly and rearwardly, and hence towards and away, from the central structure 201. In the embodiment shown in FIG. 6, this pivotal control of the parallelogram formed by the central structure, each hull member and associated struts is controlled by cable and winch means.

Hydrofoils 210, 212 are pivotally mounted at their lower ends one on each side of a fairing 222 provided at the bottom of a retractable fin 209 depending from the underside of the central structure in line with the mast 202. This embodiment of the catamaran shows an alternative manner of attaching the upper outer ends of the hydrofoils to the struts 205, 206. In this embodiment, each hydrofoil 210, 212 pivotally carries at its upper outermost end a sleeve 240, 241. The sleeve 240 is slidably mounted on the strut 205 whilst the sleeve 241 is slidably mounted on the strut 206. A pin 242, 243 extends through the sleeve to engage in pre-drilled holes provided along the length of the struts 206. In this manner, the upper outer ends of the hydrofoils can be suitably located and retained in position on struts for each adjusted position of the retractable fin 209. The struts are pivotally mounted on the hulls 220, 221 in a manner similar to that described in connection with the trimaran shown in FIGS. 4 and 5 of the drawings.

In the embodiment shown in FIG. 7, the hydrofoils 210',212' similarly carry sleeves at their upper outer ends to slide on the rearward pivotally mounted struts 205',206'.

Figure 8:
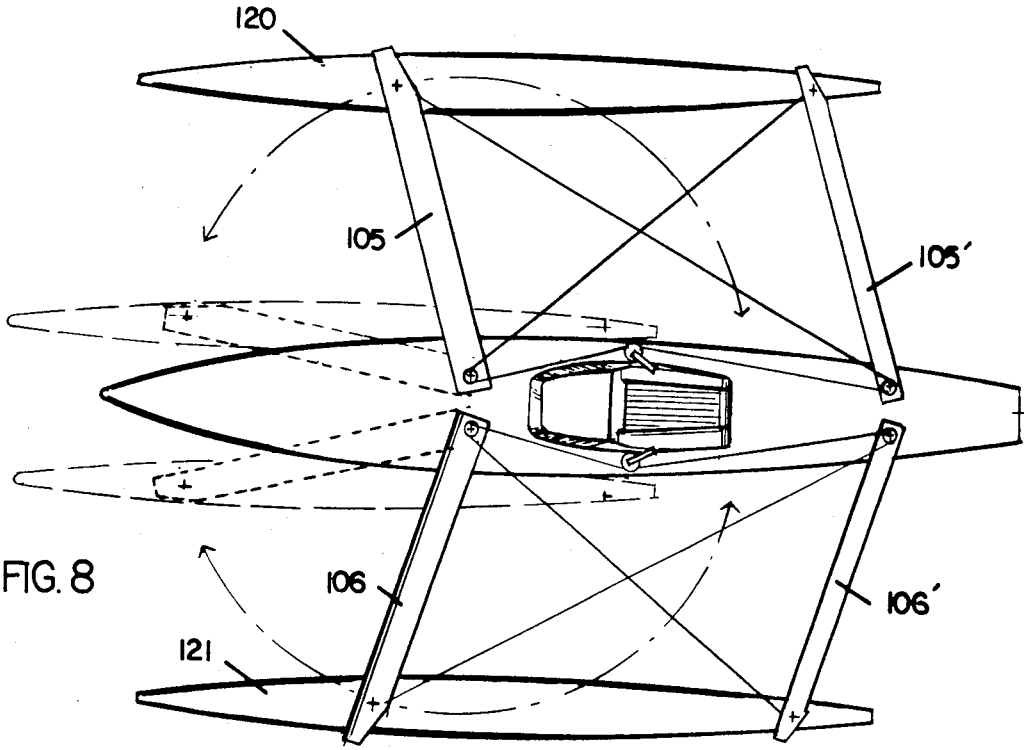
FIG. 8 is a top-plan view of the embodiment shown in FIG. 3.
Figure 9:
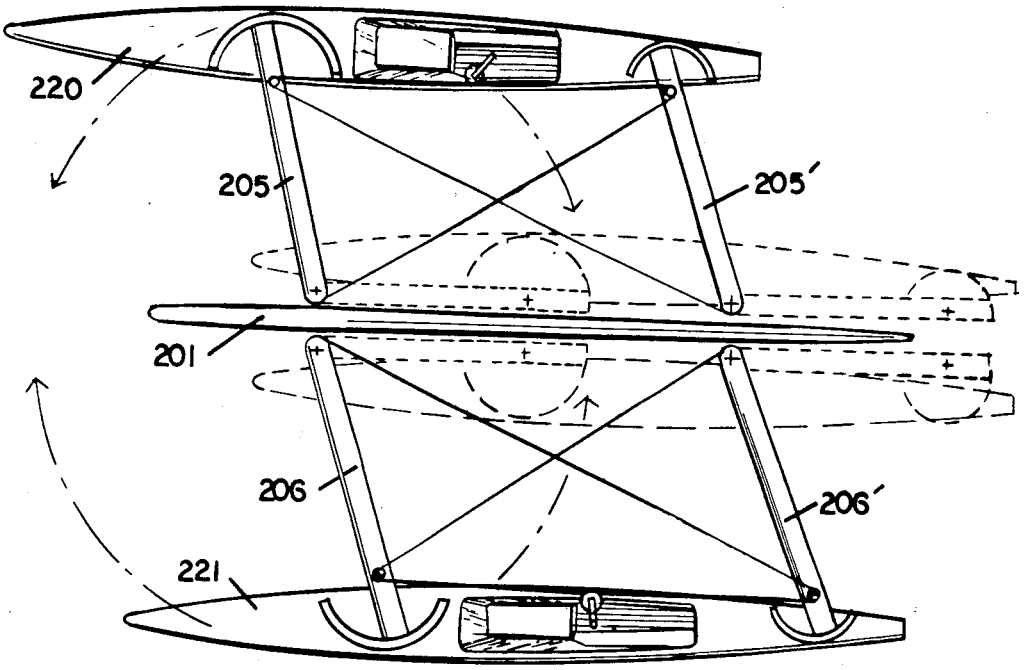
FIG. 9 is a top-plan view of the embodiment shown in FIG. 6.

FIGS. 8 and 9 show schematic plan views of the vessels illustrated in, and described with reference to, FIGS. 3 and 6 of the drawings. These FIGS. 8 and 9 show how, in the case of a trimaran, the outer hulls can be pivoted forwardly to a position in which they lie alongside and adjacent to the main hull and FIG. 9 shows how the hulls of a catamaran may be pivoted forwardly until they lie adjacent to alongside the central structure. In each case, control of the pivotal movement of the struts is effected by a cable and winch system. However, it will be appreciated that the cable and winch system could be readily be replaced by a hydraulic jack system as shown in schematically in the single hull embodiment of FIG. 1 of the drawings.

Figure 10:
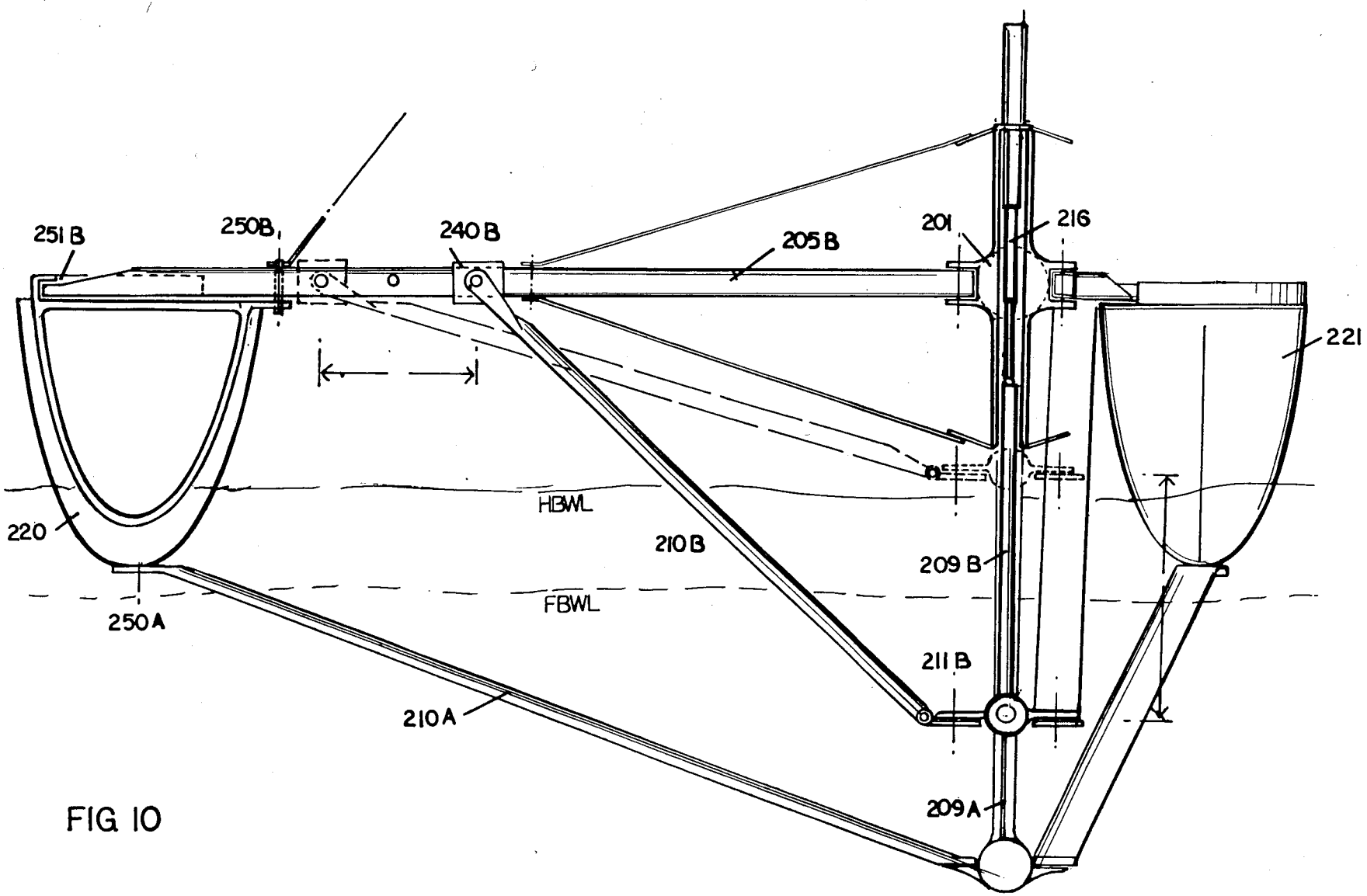
FIG. 10 is a partial front elevation, on an enlarged scale, of the embodiment shown in FIG. 7.

In the foregoing description, several alternative pivotally mountings between the hydrofoils and the struts have been described. In the single hull embodiment of FIG. 1, the struts may be secured to the hydrofoils at their outer ends since, in the absence of outrigger hull members, the desired pivotal movement of the struts and hydrofoils can be effected by the pivots 7, 8 and 11, 13. In that embodiment, the struts 5 and 6 are capable of a degree vertical motion depending on the extension or retraction of the fin 9. Such vertical motion is facilitated if the outer end of the strut 5 is pivotally connected to the hydrofoil 10 and the outer end of the strut 6 is similarly pivotally connected to the hydrofoil 12. In the multi-hull versions, the outer ends of the struts and hydrofoils may be pivotally interconnected on opposite sides of the outer hull members (FIG. 3), may be pivotally interconnected proximate the upper portion or deck of the outer hulls (trimaran embodiment of FIG. 4) or may be pivotally interconnected through the intermediary of slidable sleeves movable along the length of the struts (catamaran embodiment of FIG. 6). It will be appreciated that the illustrated and described interconnections between the struts and hydrofoils are not limited to any specific type of vessel. Thus, for example, a sliding sleeve could be used to interconnect the hydrofoils 110, 112 with the struts 105, 106 inwardly of the outer hulls in the trimaran shown in FIG. 3. Similarly, the hydrofoils 210, 212 could be pivotally connected to the underside of the hulls 220, 221 in the catamaran shown in FIG. 6. FIG. 10 of the drawings shows alternative ways in which pivotally to interconnect the hydrofoils and the struts. Thus, a hydrofoil 210A is shown pivotally mounted at 211A at the lower end of a fin 209A and at the outer end is pivotally connected at 250A to the underside of a hull 220. Alternatively, a hydrofoil 210B is pivotally connected 211B to a fin 209B and at its outer end carries a sleeve 240B slidable on a strut 205B. That strut, in turn, is pivotally connected at 250B to the upper portion of the hull 220. The pivotal connection 250B is displaced inwardly from the outer extremity of the strut 205B and that outer extremity runs in an arcuate channel 251B. In this manner the fin 209A or 209B can be raised or lowered as desired, conveniently by a hydraulic ram assembly 216.

The embodiment, 209A, 210A, 211A, 250A has the advantage that with the strut **205*b* pivotally connected to the upper portion of the hull 220** and with the hydrofoil pivotally connected to the lower portion thereof, any tendency of that hull to rotate or twist when the vessel is in motion is restrained.

FIG. 10 also shows how one hull 221 in a catamaran can be brought forwardly to lie proximate the central structure 201 whilst the other hull 220 remains at the maximum distance therefrom permitted by the length of the struts.

Figure 11:
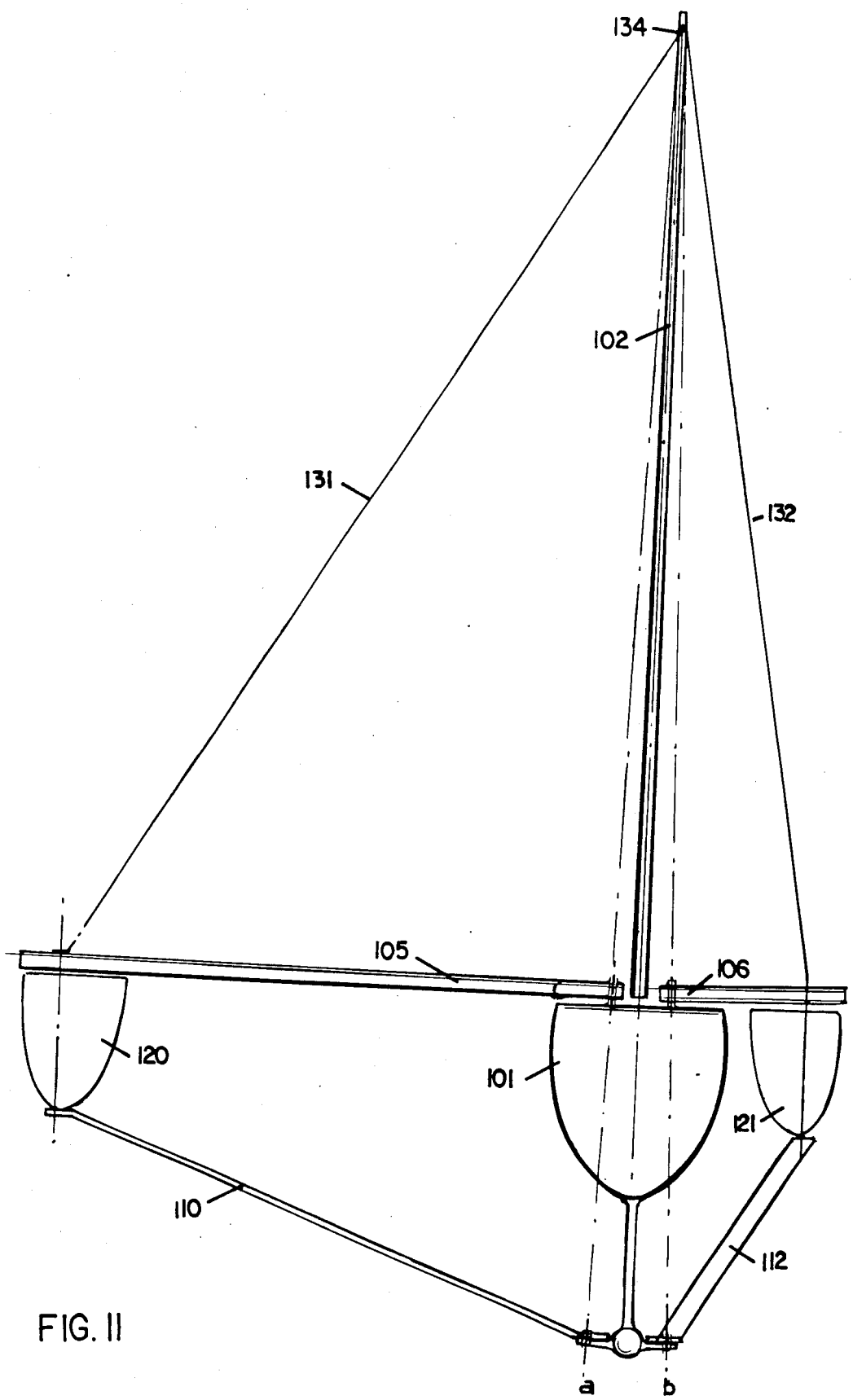
FIG. 11 is a further front elevation of an alternative embodiment.

FIG. 11 is a schematic illustration more clearly showing how the axes a and b extending through the pivotal mountings of the lower ends of the hydrofoils 110, 112 and the pivotal mountings of the struts 105, 106 intersect the mast 102 at the location of the anchorage 134 of the shrouds 131, 132. As explained, in this manner there will be no change in the length of the shrouds as the outer hulls of a trimaran pivotally swing towards the main hull by virtue of the parallelogram created by the main and outer hulls and the interconnecting struts.

Figure 12:
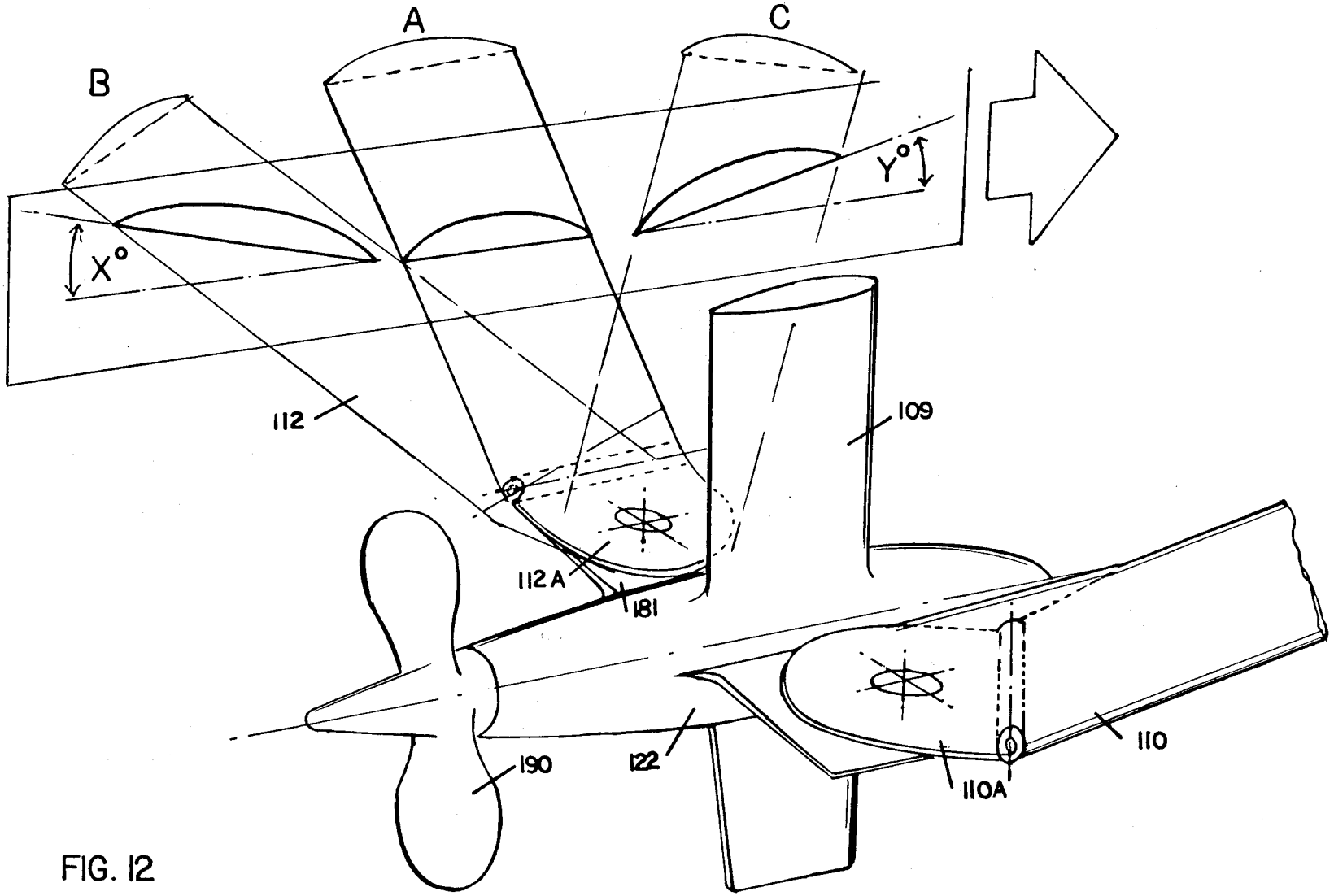
FIG. 12 is an enlarged perspective view of a detail of a vessel incorporating the invention.

Turning now to FIG. 12 of the drawings, this figure shows an enlarged perspective view of the fairing 122 at the bottom of the fin 109 and the pivotal mountings of the hydrofoils 110, 112. These hydrofoils are shown terminating in hinged sections **110*a* and 112*a* which are pivotally mounted on laterally projecting flanges 180, 181**.

More importantly FIG. 12 of the drawings shows how the angle of attack of the hydrofoils is altered as the hydrofoils pivot forwardly with respect to the central longitudinal axis of the vessel. In the embodiment shown, the hydrofoil has a horizontal underside and a convex upper side. At position A the hydrofoil is shown extending laterally outwardly substantially at right angles to the vessel longitudinal axis. In position B, the hydrofoil has been pivoted rearwardly and the underside of the hydrofoil is seen to be tilted through an angle of X degrees. In position C the hydrofoil is pivoted forwardly and the underside of the hydrofoil is seen to lie at an equal but, in this case, opposite angle of Y degrees. As the hydrofoil pivots forwardly in the direction of the arrow in FIG. 12, the angle of attack will continually alter causing an increase in the angle Y.

Finally, FIG. 12 schematically shows how an auxiliary motive unit can conveniently be accommodated on the fairing. To this end a propeller 190 is schematically shown and this propeller may be driven by, for example, a storage battery or even a small generator mounted within the fairing. Any increase in the weight of the fairing will act as ballast when sailing and will further assist in righting the vessel if capsized.

I claim:

1. A catamaran vessel incorporating spaced parallel twin hull members interconnected by struts, at least one pair of hydrofoils diverging upwardly from a location below said hull members and adjustable support means interconnecting said hull members and said hydrofoils, the lower end of each said hydrofoil being mounted for pivotal movement about a substantially vertical axis to permit forward and rearward movement of the hydrofoils about said substantially vertical pivotal axis and with respect to said hull members thereby to alter the angle of attack of said hydrofoils, and the upper outer ends of the hydrofoils being slidable on said struts and being selectively fixable at desired positions along the lengths thereof.

2. A vessel as claimed in claim 1, wherein the struts extend outwardly to the hull members from a central structure, the inner ends of said struts being pivotally mounted on said central structure, and wherein a fin depends from the underside of said central structure and carries pivotal mounting means for the hydrofoils proximate the lower end of said fin.

3. A vessel as claimed in claim 2, wherein the fin is longitudinally displaceable in a vertical plane.

4. A vessel as claimed in claim 2, wherein each strut is pivotally attached at a location spaced inwardly from its outer extremity to a point proximate the inner gunwale of the associated hull member and the outer extremity of each strut is slidable around an arcuate guide located on the upper portion of said hull member.

5. A trimaran comprising a main hull member, two outer hull members located one on each side of said main hull member in substantially parallel relationship therewith, two spaced parallel struts interconnecting said main hull member with each outer hull member, each of said struts being pivotally connected at each end to the respective hull members, at least one pair of hydrofoils diverging upwardly from a location below said main hull member towards said outer hull members, said hydrofoils being pivotally mounted at their lower ends for pivotal movement about substantially vertical axes whereby each strut and hydrofoil may pivot forwardly and rearwardly about the respective pivotal axis to alter the spacing between the main hull member and associated outer hull member and to alter the angle of attack of the hydrofoil, each said strut being pivotally connected at a point inwardly displaced from its outer extremity to a point proximate the inner gunwale of the associated outer hull member and the outer extremity of each strut being slidable around a guide located on the upper portion of the outer hull member.

6. A sailing trimaran comprising a main hull member, a mast projecting upwardly from the main hull member and supported by shrouds, two outer hull members located one on each side of said main hull member in substantially parallel relationship therewith, strut means pivotally interconnecting said main hull member with the outer hull members, at least one pair of hydrofoils diverging upwardly from a location below said main hull member towards said outer hull members, said hydrofoils being pivotally mounted at their lower ends for pivotal movement about substantially vertical axes whereby each strut and hydrofoil may pivot forwardly and rearwardly about the respective pivotal axis to alter the spacing between the main hull member and associated outer hull member and to alter the angle of attack of the hydrofoil, said shrouds being attached to said mast at the points at which the pivot axes through the pivot points of the lower ends of the hydrofoils and the pivot points of the ends of the struts pivotally connected to said main hull member intersect with said mast.

7. A catamaran comprising substantially parallel twin hull members, central structure located between said hull members, two spaced parallel struts interconnecting the central structure with each hull member, each of said struts being pivotally connected at one end to the central structure and at the other end to a hull member, at least one pair of hydrofoils diverging upwardly from a location below said central structure towards said hull members, said hydrofoils being pivotally mounted at the lower ends thereof for pivotal movement about substantially vertical axes whereby each said strut and hydrofoil may pivot forwardly and rearwardly about the respective pivotal axis to alter the spacing between the central structure and the hull members to alter the angle of attack of the hydrofoil and the outer ends of the hydrofoils being slidably mounted on the struts for movement therealong.

8. A catamaran comprising substantially parallel twin hull members, central structure located between said hull members, two spaced parallel struts interconnecting the central structure with each hull member, each of said struts being pivotally connected at the inner end to the central structure and at the outer end to a hull member and each strut being pivotally connected at a point inwardly displaced from its outer extremity to a point proximate the inner gunwale of the associated hull member and the outer extremity of each strut being slidable around a guide located on the upper portion of said associated hull member, at least one pair of hydrofoils diverging upwardly from a location below said central structure towards said hull members, said hydrofoils being pivotally mounted at the lower and upper ends thereof whereby each said strut and hydrofoil may pivot forwardly or rearwardly to alter the spacing between the central structure and the hull members to alter the angle of attack of the hydrofoil.

9. A sailing catamaran comprising substantially parallel twin hull members, central structure located between said hull members, a mast projecting upwardly from the central structure and supported by shrouds, strut means pivotally interconnecting said central structure with said hull members, at least one pair of hydrofoils diverging upwardly from a location below said central structure towards said hull members, said hydrofoils being pivotally mounted at the lower and upper ends thereof whereby each said strut and hydrofoil may pivot forwardly or rearwardly to alter the spacing between the central structure and the hull members to alter the angle of attack of the hydrofoil, said shrouds being attached to said mast at the points at which the pivot axes through the pivot points of the lower ends of the hydrofoils and the pivot points of the ends of the struts pivotally connected to said central structure intersect with said mast.

* * * * *